US011519394B2

(12) United States Patent
Bauer et al.

(10) Patent No.: US 11,519,394 B2
(45) Date of Patent: Dec. 6, 2022

(54) BUFFERED PUMP SYSTEM

(71) Applicant: The Procter & Gamble Company, Cincinnati, OH (US)

(72) Inventors: Matthew Stephen Bauer, Loveland, OH (US); Richard Lee Lane, Cincinnati, OH (US); Cody Dylan Lewis, Lawrenceburg, IN (US); James Alexander Morley, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 204 days.

(21) Appl. No.: 16/451,394

(22) Filed: Jun. 25, 2019

(65) Prior Publication Data

US 2020/0406277 A1 Dec. 31, 2020

(51) Int. Cl.

| | |
|---|---|
| ***F04B 9/14*** | (2006.01) |
| ***B05B 11/00*** | (2006.01) |
| ***F04B 23/02*** | (2006.01) |
| ***F04B 7/02*** | (2006.01) |

(52) U.S. Cl.

CPC ..... *F04B 9/14* (2013.01); *B05B 11/304* (2013.01); *B05B 11/3011* (2013.01); *B05B 11/3016* (2013.01); *B05B 11/3069* (2013.01); *F04B 7/0266* (2013.01); *F04B 23/028* (2013.01)

(58) Field of Classification Search

CPC ..... F04B 9/14; F04B 11/0008–0033; F04B 17/06; F04B 23/028; B05B 11/3011; B05B 11/3016; B05B 11/3038–304; B05B 11/3057; B05B 11/30–3001; B05B 11/3009–3011; B05B 11/3015–3016; B05B 11/3069

USPC ..... 222/321.2, 340, 341, 372, 380, 383.1; 417/541, 544

See application file for complete search history.

(56) References Cited

U.S. PATENT DOCUMENTS 4,109,832 A 8/1978 Kutik
4,174,056 A * 11/1979 Loeffler ..... B05B 11/3004 222/321.7
4,222,501 A * 9/1980 Hammett ..... B05B 11/303 222/207

(Continued)

FOREIGN PATENT DOCUMENTS

JP 5946134 B2 6/2016
JP 5982301 B2 8/2016

(Continued)

OTHER PUBLICATIONS

International Search Report for International Application No. PCT/US2020/070177, dated Sep. 24, 2020, 14 pages.

*Primary Examiner* — Alexander B Comley
(74) *Attorney, Agent, or Firm* — Carolyn S. Powell; Gary Joseph Foose

(57) ABSTRACT

A pump including an inlet one-way valve; a pump chamber downstream of and in fluid communication with the inlet one-way valve; a piston slideably engaged with the pump chamber; a piston cavity within the piston and in fluid communication with the pump chamber; a liquid accumulator operable within the piston cavity; an actuator engaged with piston; and an outlet one-way valve downstream of and in fluid communication with the pump chamber.

17 Claims, 7 Drawing Sheets

(56) References Cited

U.S. PATENT DOCUMENTS

| | | | | | |
|---|---|---|---|---|---|
| 4,241,853 | A * | 12/1980 | Pauls | B05B 9/0883 | 222/207 |
| 4,365,751 | A * | 12/1982 | Saito | B05B 11/3011 | 222/212 |
| 4,489,890 | A * | 12/1984 | Martin | B05B 1/3436 | 239/333 |
| 4,618,077 | A * | 10/1986 | Corsette | B05B 11/304 | 222/383.1 |
| 5,092,495 | A * | 3/1992 | Andre | B05B 11/3088 | 222/321.2 |
| 6,341,950 | B1 * | 1/2002 | Schuller | B60T 8/4031 | 417/541 |
| 8,905,271 | B2 | 12/2014 | Maas | | |
| 9,981,278 | B2 | 5/2018 | Tu | | |
| 2013/0112766 | A1 | 5/2013 | Maas et al. | | |
| 2014/0246506 | A1 | 9/2014 | Maas | | |
| 2017/0072416 | A1 * | 3/2017 | Maas | B05B 11/3012 | |
| 2019/0151875 | A1 | 5/2019 | Laidler | | |

FOREIGN PATENT DOCUMENTS

| | | | |
|---|---|---|---|
| WO | 2016177997 | A1 | 11/2016 |
| WO | 2016205408 | A1 | 12/2016 |

* cited by examiner

BUFFERED PUMP SYSTEM

FIELD OF THE INVENTION

Buffered pump system.

BACKGROUND OF THE INVENTION

Manually actuated pump driven sprayers are widely employed to dispense consumer products. Typically the manually actuated pump driven sprayers are driven by a trigger or pump cap. These types of pumps tend to deliver a fixed volume of liquid for each down stroke of the pump. A predictable, albeit sometimes disappointing, consumer experience can be provide by such pumps, since the onset and cessation of liquid flow may not be controllable by the user. And, the range of variability in particle size, velocity, and cone angle of the spray may be high, and poorly suited to the particular job being performed by the user.

Precompression sprayers can help to overcome some of the deficiencies of simple manually actuated pump driven sprayers. Precompression sprayers employ a precompression valve in the outlet liquid stream that only opens and remains open when the liquid pressure exceeds a certain magnitude. Precompression sprayers help to provide a distinct onset and cessation of liquid flow from the sprayer. Precompression sprayers likewise tend to deliver a fixed volume of liquid for each down stroke, with the improvement being that discharge occurs only above a certain pressure. This type of system may present a drawback to some consumers depending on stroke speed, since the increased pressure of fast strokes, while driving improved particle size distribution, velocity, and cone angle, also increases the force to actuate.

Manually actuated pump driven sprayers that employ a buffer system to provide for continuous discharge with repetitive pump strokes are also available. Buffered pump systems include a reservoir capable of storing a volume of liquid under pressure so that liquid can be discharged during the up stroke of the pump. This type of system helps to mitigate negative associated with variable stroke rate, such as variable particle size distribution, velocity, cone angle, and force to actuate. The concept of operation of a buffered pump system is that a greater quantity of liquid is pumped than can exit the pump. Excess liquid is stored under pressure in the buffer. The buffer can release stored liquid on the return stroke or if the actuation rate is lower than necessary to supply the desired amount of liquid to exit the sprayer or if actuation is stopped. Buffered pump systems can suffer from a lack of control in some operating conditions. For example, when the consumer believes that a single down stroke will dispense the desired volume of liquid, liquid may continue to be discharged from the buffer. Users may be surprised that a significant volume of liquid may be discharged even after the up stroke is started. The spraying behavior of the pump may vary greatly depending on if short intermittent incomplete down strokes are employed versus long continuous complete down strokes are employed With these limitations in mind, there is a continuing unaddressed need for a manually actuated pump driven sprayer having a buffer system that provides users with adequate control when short intermittent incomplete down strokes are employed and when long continuous complete down strokes are employed as well as provide for adequate sprayer performance related to particle size distribution, velocity, cone angle, and force to actuate.

SUMMARY OF THE INVENTION

A pump comprising: an inlet one-way valve; a pump chamber downstream of and in fluid communication with said inlet one-way valve; a piston slideably engaged with said pump chamber; a piston cavity within said piston and in fluid communication with said pump chamber; a liquid accumulator operable within said piston cavity; an actuator engaged with said piston; and an outlet one-way valve downstream of and in fluid communication with said pump chamber.

DETAILED DESCRIPTION OF THE INVENTION

Figure 1:
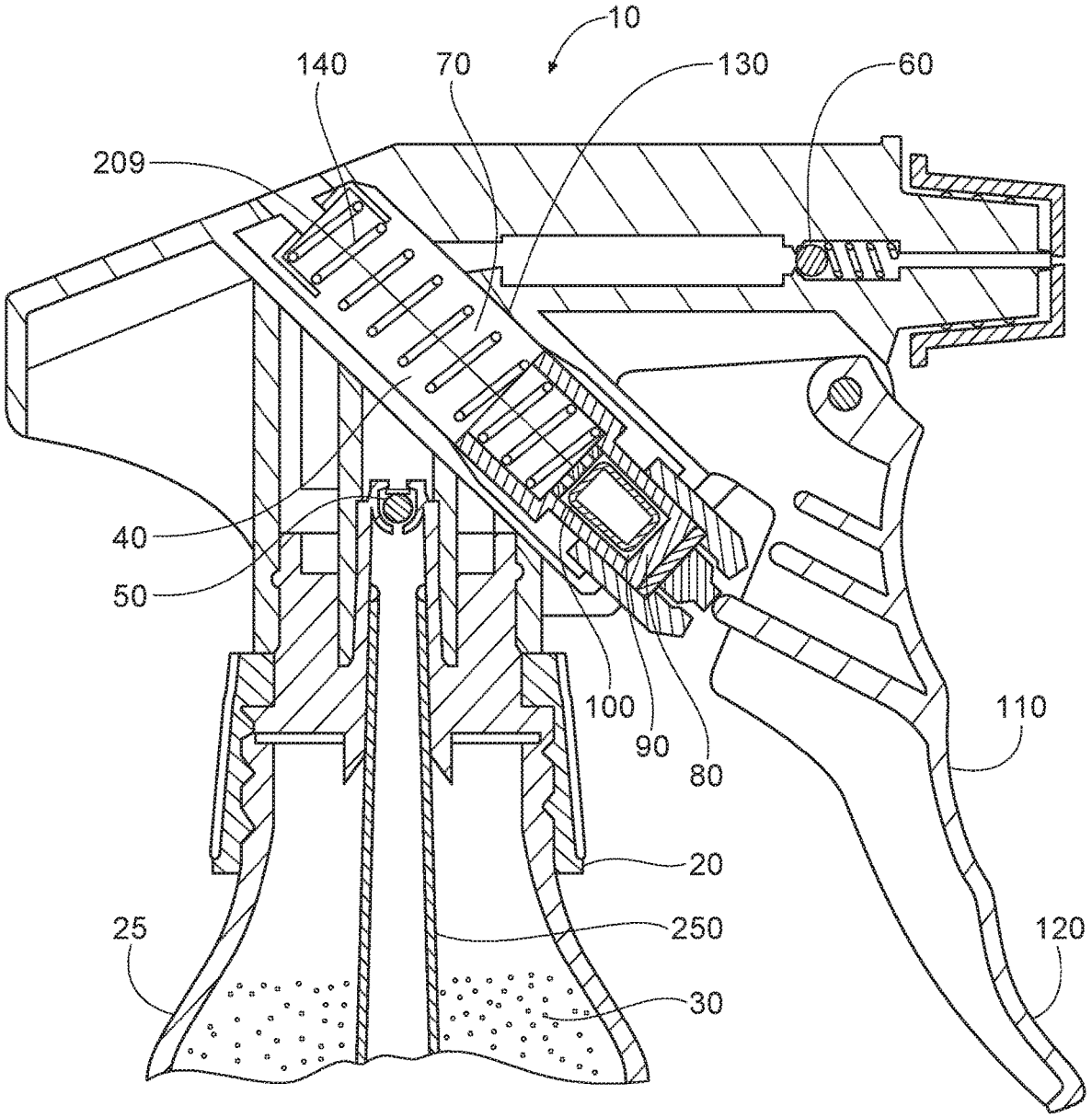
FIG. 1 is a pump.

A cross section of a manually actuated pump sprayer 10 is shown in FIG. 1. In pertinent part, a manually actuated the pump sprayer 10 can have a collar 20 or some other fitment that can be fitted to a container 25. The container 25 can contain the liquid 30 to be dispensed using the pump sprayer 10.

The pump 40 can comprise an inlet one-way valve 50. There can be a dip tube 250 upstream of the inlet on-way valve 50. The pump 40 can be considered to provide for movement of liquid downstream from the inlet one-way valve 50 to the outlet one-way valve 60. The inlet one-way valve 50 can be a ball valve that opens and closes in response to a change in pressure in the pump chamber 70. Liquid 30 is drawn through the inlet one-way valve 50 into the pump chamber 70. The pump chamber 70 is downstream of and in fluid communication with the inlet one-way valve 50. The inlet one-way valve 50 can be one-way in the direction downstream from the inlet one-way valve 50 towards the pump chamber 70 and prevent movement of liquid 30 in an upstream direction from the pump chamber 70 through the inlet one-way valve 50 towards the container 25.

The pump 40 can comprise a piston 80 that is slideably engaged with the pump chamber 70. As illustrated in FIG. 1, the pump 40 is a trigger actuated pump 40. When the piston 80 moves to expand the pump chamber volume, which is the up stroke of the piston 80, liquid 30 can be drawn in through the inlet one-way valve 50 into the pump chamber 70. The pump chamber 70 has a pump chamber volume that is a function of position of the piston 80. On the down stroke of the piston 80, the pump chamber volume decreases and liquid previously drawn into the pump chamber 70 is discharged downstream towards the outlet one-way valve 60.

The pump chamber volume when the piston 80 is at its up stroke can be from about 0.25 to about 6 mL, optionally about 0.5 to about 3 mL. Pump chamber volume when the piston 80 is at its down stroke can be from about 0 mL to about 2 mL. The upstroke pump chamber volume is measured between the inlet one-way valve 50 and the outlet one-way valve 60 with the piston 80 located at its upstroke position.

The pump 40 can comprise an outlet one-way valve 60 downstream of an in fluid communication with the pump chamber 70. The outlet one-way valve 60 can be one-way in the direction downstream from the outlet one-way valve 50. The outlet one-way valve 60 can be a ball valve that opens and closes in response to a change in pressure in the pump chamber 70. The outlet one-way valve 60 can prevent movement of liquid 30 or air in an upstream direction from downstream of the outlet one-way valve 60 through the outlet one-way valve 60 towards the pump chamber 70. The outlet one-way valve 60 can have an opening pressure of from about 200 kPa to about 500 kPa. The inlet one-way valve 50 and outlet one-way valve 60 can be selected from the group consisting of slit valves, disc valve, ball, valve, diaphragm valves.

The pump 40 can comprise an actuator 110 engaged with the piston 80. The actuator 110 can be a trigger 120. Optionally, the actuator 110 can be a surface of the piston 80 presented external to the pump 40 or optionally some other molded part or surface of a part that is operably engaged with the piston 80.

The pump sprayer 10 can comprise a piston cavity 90 within the piston 80. The piston cavity 90 can be in fluid communication with the pump chamber 70. Further, the pump sprayer 10 can comprise a liquid accumulator 100 that is operable within the piston cavity 90. The liquid accumulator 100 provides for a buffer in the pump sprayer 10. The buffer, which is the liquid accumulator 100 associated with the piston 80, provides users with adequate control when short intermittent incomplete down strokes are employed and when long continuous complete down strokes are employed. The piston cavity 90 can have a volume from about 0.1 to about 4 mL, optionally from about 0.25 to about 2 mL, excluding the components forming liquid accumulator within the piston cavity 90. The piston cavity 90 can have an open cross sectional area of from about 4 to about 500 $mm^2$, optionally about 9 to about 250 $mm^2$. The pump chamber 70 can have an upstroke pump chamber volume and the piston cavity 90 can have a piston cavity volume that is from about 0.2 to about 0.8 of the pump chamber volume. Providing this relative size of piston cavity volume and upstroke pump chamber volume can provide buffering capacity when short intermittent pump strokes are applied by the user.

The pump 40 described herein contrasts with a buffered pump in which the buffer system is downstream of a one-way valve positioned between the pump chamber and the buffer system. A buffer system that is downstream of a one-way valve positioned between the pump chamber and the buffer system suffers from the defect that if the buffer system is mobilized, liquid and pressure is stored downstream of the one-way valve and liquid will continue to be discharged until the pressure above atmospheric pressure is relieved in the buffering system or until the pressure in the buffer system decreases to the opening pressure of one-way valve downstream of the buffer system. If the buffer system is fully mobilized, an appreciable quantity of liquid may be discharged shortly after or even well after the user has stopped actuating the pump. This can surprise users of the buffered pump sprayer of this type which can result in the user dispensing much more than the desired quantity of liquid or dispensing liquid in an unintended direction.

To operate a buffered pump in which the buffer system is downstream of a one-way valve positioned between the pump chamber and the buffer system, the user actuates the pump one or more times to push liquid past the one-way valve, if sufficient pressure is developed in the pump sprayer downstream of the one-way valve, the buffer system is mobilized to store liquid under the pressure developed downstream of the one-way valve. The volume of liquid that the buffer system acquires is a function of pressure up to whatever pressure is required to mobilize the full volume of the buffer system. Continuous spraying that occurs during actuation of the pump and for some period of time after the pump is no longer actuated can be achieved by over supplying liquid past the one-way valve that is between the pump chamber and the buffer. The buffered pump can optionally have a relief valve downstream of the one-way valve that routes liquid outside the pump chamber back to the container if the pressure in the buffer system or other part of the pump sprayer downstream of the one-way valve exceeds some desired magnitude.

To more closely associate actuation of the piston 80 with operation of a buffer system, it can be practical to provide a liquid accumulator 100 operable within the piston cavity 90. Providing the liquid accumulator 100 as part of the piston 80 can have an advantage over positioning the liquid accumulator 100 as part of or off of the pump chamber 70 in that molding of the parts may be simplified, assembly of parts may be simplified, there is a reduced potential for leakage if an assembly of parts forms the liquid accumulator, and fewer overall pieces may need to be manufactured and assembled.

A liquid accumulator 100 is operable within the piston cavity 90 when some portion of liquid is accumulated in a portion of the volume of the piston cavity 90. The piston cavity 90 defines an open volume within the piston 80. Since the piston cavity 90 is within the piston 80, the piston cavity 90 can be considered to move or be movable in concert with the piston 80. The piston 80 can be considered to be the part of the pump 40 that reciprocates or moves in reciprocating motion. There can be a liquid pervious cover 209 over the accumulator piston 205. The cover 209 can act to confine the components of the liquid accumulator 100 within the piston cavity 90.

The pump 40 can comprise a resilient member 140 engaged with the actuator 110. The resilient member 140 can be a spring within the pump chamber 70 that is engaged with the piston 80, the piston 80 being in turn engaged actuator 110. The resilient member 140 can act to apply force to the piston 80 directly or indirectly through another part to force the up stroke of the piston 80. The resilient member 140 can be biased to expand the pump chamber volume, which will act to draw liquid into the pump chamber 70. The resilient member 140 can be biased to move the piston 80 through the up stroke of the piston 80. A resilient member 140 within the pump chamber 70 can be easy to assemble, for instance by inserting the resilient member 140 into the pump chamber 70 before assembling the piston 80.

Optionally the resilient member 140 can be outside of the pump chamber 70. For instance, the resilient member may be positioned between the trigger 120 and the body of the pump 40. A resilient member 140 outside of the pump chamber 70 can be practical for increasing the available volume of the pump chamber volume and for eliminating potential chemical incompatibility problems between the resilient member 140 and the liquid 30.

The pump chamber 70 can comprise a piston bore 130. The piston 80 can move reciprocatingly within the piston bore 130. The piston 80, or a portion of the piston 80, can be slideably engaged with the piston bore 80. If a piston bore 130 is provided, the part of the piston bore 130 in fluid communication with liquid in the pump chamber 70 is the pump chamber 70. So together, that part of the piston bore 130 and the pump chamber 70 make up the pump chamber 70. And the pump chamber volume is a function of position of the piston 80 in the piston bore 80. The piston bore 130 can have an open cross section area orthogonal to the direction of the piston bore 130 from about 4 to about 500 $cm^2$, optionally about 9 to about 250 $mm^2$. The length of the piston bore 130 can be from about 5 to about 35 mm, length being measured in line with the direction of movement of the piston 80 and the length of the stroke of the piston 80.

Figure 2:
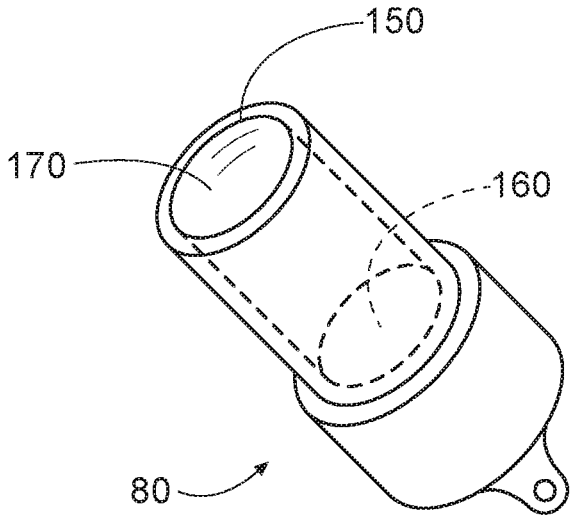
FIG. 2 is piston and the piston cavity is shown.

A piston 80 is shown if FIG. 2. The piston cavity 90 within the piston 80 can be defined by a piston cavity opening 150 and a piston cavity closed end 160 and a piston cavity peripheral wall 170 extending from the piston cavity closed end 160 to the piston cavity opening 150. The piston cavity opening 150 can be oriented towards the pump chamber 70. The piston cavity closed end 160 can be oriented towards the actuator 110.

Figure 3:
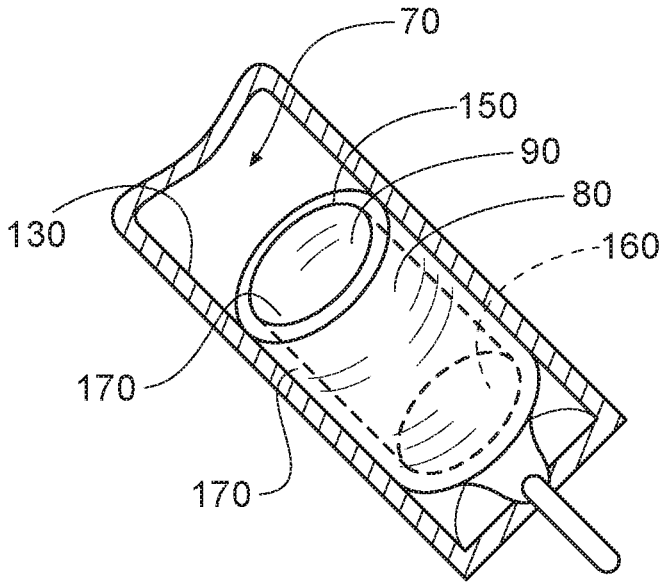
FIG. 3 is a partial view of a pump chamber housing the piston. The piston cavity peripheral wall is slideably engaged with the pump chamber.

The piston cavity 90 is part of the piston 80. Part of the piston 80 is slideably engaged with the pump chamber 70, or piston bore 130 if provided. The piston cavity 90 can be part of the piston 80 that is not slideably engaged with the pump chamber 70. The piston cavity 90 can extend from the part of the piston 80 that is slideably engaged with the pump chamber 70. Optionally piston cavity peripheral wall 170 can slideably engaged with the pump chamber 70. For instance, for the piston 80 shown in FIG. 2, the piston cavity can be expanded radially so that the piston cavity peripheral wall 170 conforms with the remainder of the piston 80, for example as shown in FIG. 3. For instance, the portion of the piston 80 slideably engaged with the pump chamber 70 can be cylindrical or another shape in which having surfaces parallel to the direction of movement of the piston 80. The piston cavity 90 can be arranged in other more complicated manners that may provide some benefit so long as the liquid accumulator 100 is operable within the piston cavity 90.

The liquid accumulator 100 can be any construction that permits liquid 30 to be accumulated therein under pressure and expand in stored volume of liquid 30 under increasing pressure and contracting in stored volume of liquid 30 under decreasing pressure. Space for storing the stored volume of liquid is provided for by the piston cavity 90. A liquid accumulator 100 accumulates liquid 30 with increasing pressure and discharges liquid 30 with decreasing pressure.

The liquid accumulator 100 can be selected from the group consisting of a bladder accumulator, diaphragm accumulator, gas filled piston accumulator, spring type accumulator, and compressible media accumulator, and combinations thereof.

Figure 4:
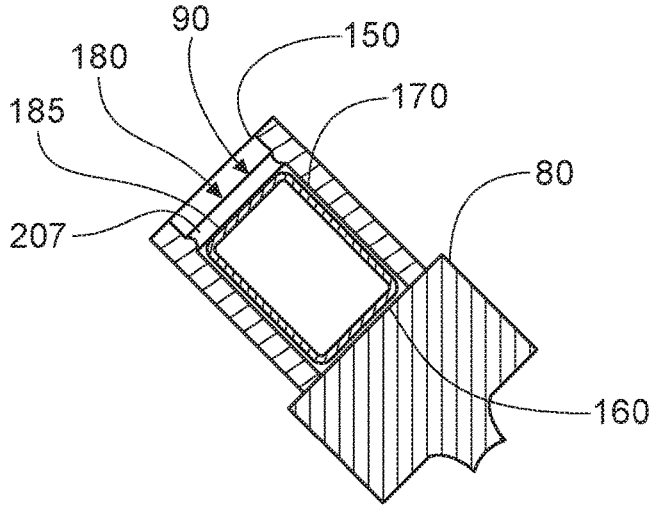
FIG. 4 is a bladder accumulator in the piston cavity.

A liquid accumulator 100 that is a bladder accumulator 180 is shown in FIG. 4. A bladder accumulator 180 can be an pocket of enclosed gas. The gas may be under a pressure that is at or above ambient pressure. In operation, a bladder accumulator 180 accumulates liquid 30 as the pressure of liquid 30 increases in the pump chamber 70 in response to the down stroke of the piston 80. Pressure in excess of ambient pressure can build in the pump chamber 70 due to the resistance to flow of liquid 30 out of the pump sprayer 10. Resistance to flow may occur as a result of the outlet one-way valve 60 and or the conduit between the outlet one-way valve 60 and or other constriction along the path of liquid flow downstream of the outlet one-way valve 60 including the exit from the pump sprayer 10, which may be a nozzle or other constriction. In conjunction with pressure building in pump chamber 70, pressure builds in the piston cavity 90. In response, the bladder 185, which is gas filled, decreases in volume once the pressure in the pump chamber 70 exceeds the pressure of the gas within the bladder 185. The bladder 185 can be formed of any pliable material that can be formed into gas filled container or pressurized gas filled container. Rebound of the bladder 185 occurs when the pressure in the pump chamber 70 decreases to a pressure below the pressure within the bladder 185. The bladder 185 expanding under a decrease in pressure in the pump chamber 70 drives liquid 30 out of the pump chamber 70. An abutment 207 can be provided within the piston cavity 90 to restrain the bladder 185 within the piston cavity 90.

The bladder 185 can be formed of a polyolefin. The bladder 185 can be formed from polypropylene, polystyrene, and ethylene vinyl alcohol. The bladder 185 can comprise metal foil, a vacuum metalized coating, and like materials. The bladder 185 can have an internal gas pressure from about 200 kPa to about 1000 kPa. The bladder 185 can have a thickness from about 0.01 mm to about 2 mm.

The bladder 185 may be restrained within the piston cavity 90 by a liquid pervious screen or obstruction over the piston cavity 90, protuberances with the piston cavity, or other such structure that will restrain the bladder 185 to remain within the piston cavity 90 even when the bladder 185 is compressed.

Figure 5:
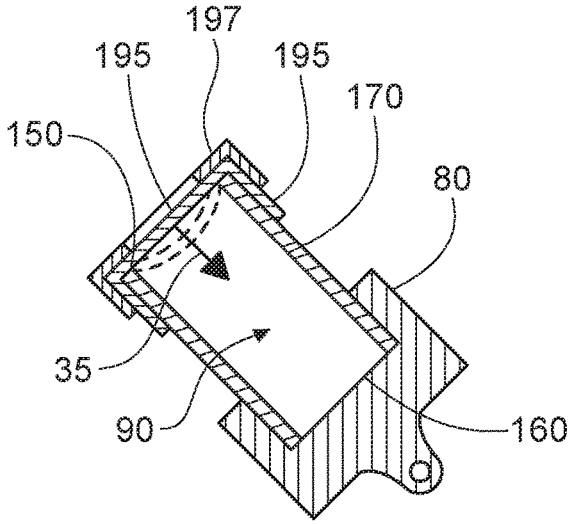
FIG. 5 is a diaphragm accumulator in the piston cavity.
Figure 7:
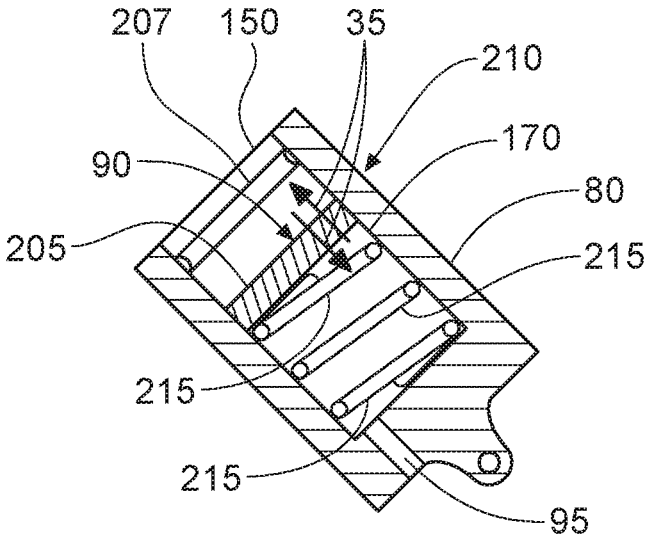
FIG. 7 is a spring-type accumulator.

The liquid accumulator 100 can be a diaphragm accumulator 190, as shown in FIG. 5. A diaphragm accumulator 190 has a diaphragm 195 across the entry into the piston cavity 90. The diaphragm 195 can be held in place by a diaphragm cap 197 fitted over the diaphragm 195 to hold the diaphragm 195 tightly against the piston cavity opening 150. The diaphragm cap 197 can be an annulus that is pressure fit over the diaphragm 195 and piston cavity opening 150. As pressure builds in the pump chamber 70, the diaphragm 195 is stretched into the piston cavity 90, as rendered in dashed lines in FIG. 5 and the arrow 35 indicates the direction in which the diaphragm can be stretched as pressure builds in the pump chamber 70. Since liquid 30 ends up within the volume defined by piston cavity 90 when the diaphragm accumulator 190 is mobilized, the piston cavity 90 is considered to be in fluid communication with the pump chamber 70. The piston cavity 90 may be unvented, in which case the gas behind the diaphragm 195 compresses and the rebound force may be provided by the gas pressure behind the diaphragm and or the potential energy stored in the stretched diaphragm 195. The piston cavity 90 may be vented (e.g. a piston vent as shown in FIG. 7) to the atmosphere, in which case the diaphragm 195 rebounds under the potential energy stored in the diaphragm 195 by elastic deformation. The rebounding of the diaphragm 195 forces liquid 30 stored within the deformed diaphragm 195 within the space within the piston cavity 90 out of the piston cavity 90 and drives liquid 30 out of the pump chamber 70. The diaphragm 195 can be formed of a polyolefin. The diaphragm 195 can be formed from polypropylene, polystyrene, and ethylene vinyl alcohol. The diaphragm 195 can comprise metal foil, a vacuum metalized coating, and like materials. The diaphragm 195 can be a thin elastically stretchable substrate. The diaphragm 195 can have a thickness from about 0.01 mm to about 2 mm.

Figure 6:
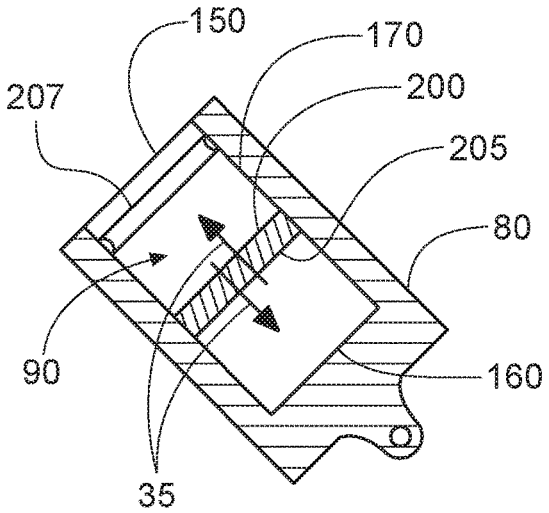
FIG. 6 is a gas filled piston accumulator

The liquid accumulator 100 can be a gas filled piston accumulator 200, as shown in FIG. 6. A gas filled piston accumulator 200 has an accumulator piston 205 within the piston cavity 90. As pressure builds in the pump chamber 70, the accumulator piston 205 is forced further into the piston cavity 90, as shown by the arrow 35 pointing in a direction deeper into the piston cavity 90 in FIG. 6. The piston cavity 90 is unvented if a gas filled piston accumulator 200 is employed. As the accumulator piston 205 is forced further into the piston cavity 90, gas pressure develops behind the accumulator piston 205. The developed gas pressure provides the rebound force on the accumulator piston 205 to drive liquid 30 out of the pump chamber 70 once pressure in the pump chamber 70 decreases to be equal to or below the gas pressure behind the accumulator piston 205. And the accumulator piston 205 moves towards the piston cavity opening 150 as indicated by the arrow 35 pointing towards the pump chamber 70. An abutment 207 can be provided within the piston cavity 90 to restrain the accumulator piston 205 within the piston cavity 90. The abutment 207 can be an interiorly raised portion of piston cavity 90, a liquid pervious cap over the piston cavity opening 150, a fitment fitted within the piston cavity 90, or other structure that sets the relaxed position of the accumulator piston 205.

The liquid accumulator 100 can be a spring type accumulator 210, as shown in FIG. 7. A spring type accumulator 210, has an accumulator piston 205 within the piston cavity 90. As pressure builds in the pump chamber 70, the accumulator piston 205 is forced further into the piston cavity 90, as shown by the arrow in FIG. 7. Behind the accumulator piston 205 is an accumulator spring 215 that takes on force developed under the pressure within pump chamber 70 acting on the accumulator piston 205. The piston cavity 90 may be vented (e.g. piston vent 95) or unvented to the atmosphere. If vented, then the accumulator spring 215 provides all the rebound force on the accumulator piston 205 to force the accumulator piston 205 to drive liquid 30 out of the pump chamber 70 once the pressure in the pump chamber 70 is at or below the pressure generated by the accumulator spring 215 pushing on the accumulator piston 205. If unvented, the rebound force on the accumulator piston 205 is provided for by a combination of the accumulator spring 215 and the gas pressure developed behind the accumulator piston 205. As liquid 30 accumulates in the liquid accumulator 100, the accumulator piston 250 moves deeper into the piston cavity 90, as shown by the arrow 35 pointed in a direction deeper into the piston cavity. As the accumulator spring 215 releases stored energy, the accumulator piston 250 is pushed towards the pump chamber 70 and the accumulator piston 250 moves as indicated by the arrow 35 pointed towards the pump chamber 70.

Figure 8:
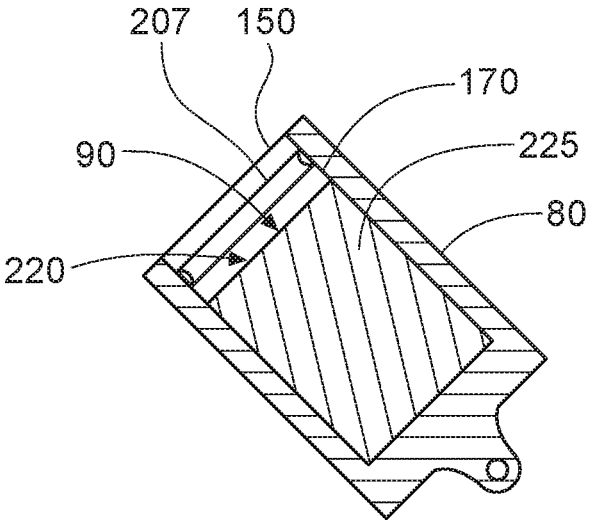
FIG. 8 is a compressible medium accumulator.

The liquid accumulator 100 can be a compressible medium accumulator 220, as shown in FIG. 8. The compressible medium 225 within the piston cavity 90 decreases in volume as pressure builds in the pump chamber 70. The compressible medium 225 can be piece of compressible rubber, closed cell foam, or other medium that sufficiently decreases in volume with increased pressure surrounding the medium. The compressible medium 225 functions in pertinent part like the bladder 185 in a bladder accumulator 180. An increase in pressure in the pump chamber 70 causes a decrease in volume of the compressible medium 225. The rebound force is stored in the compressible medium 225 as potential energy. When the pressure in the pump chamber 70 drops to be at or below the rebound pressure of the compressible medium 225, the compressible medium 225 fills space within the piston cavity 90 and drives liquid 30 out of the piston cavity 90 which drives liquid 30 out of the pump chamber 70.

Figure 9:
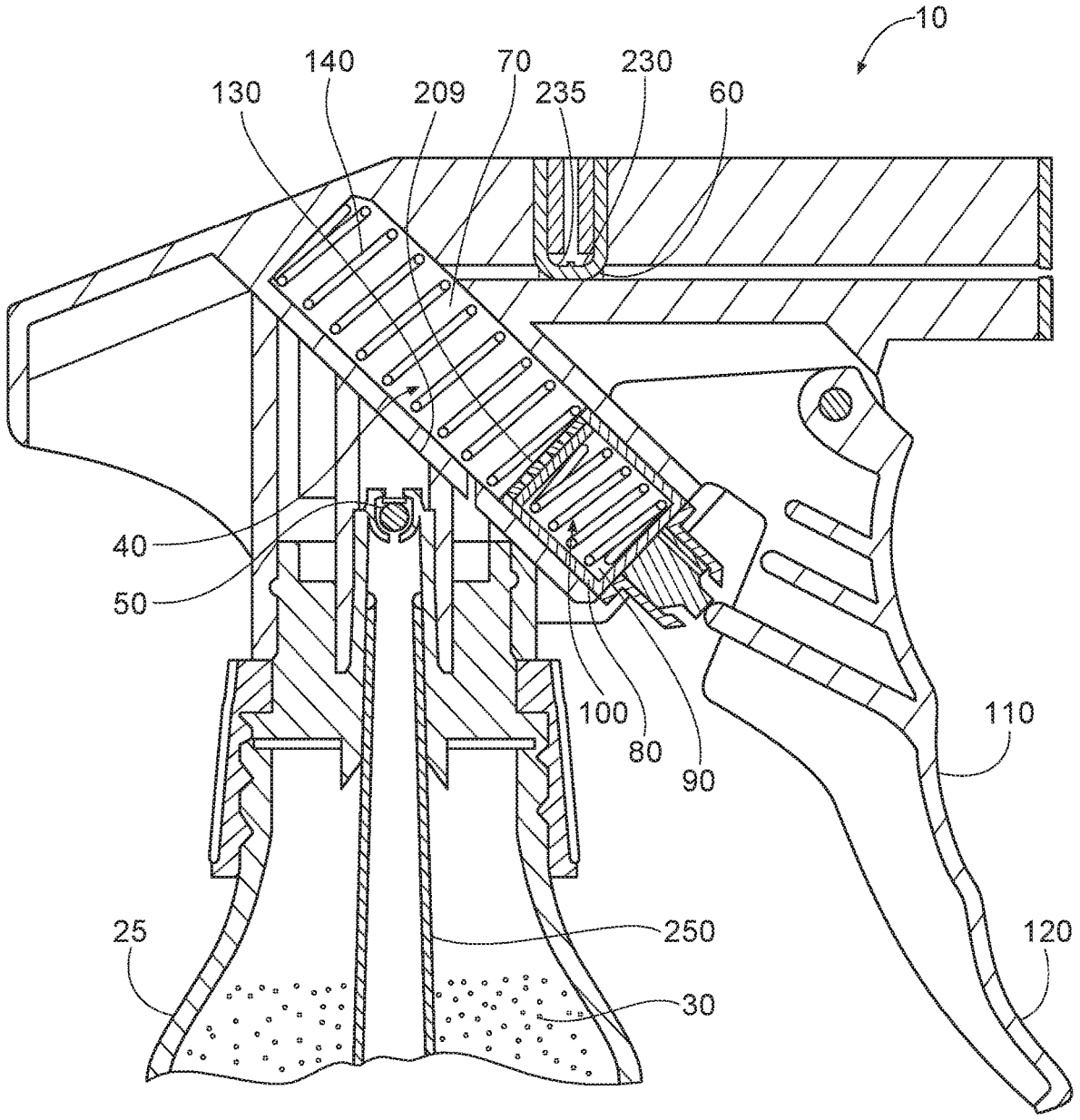
FIG. 9 is a pump having an outlet one-way valve that is a dome valve.

The outlet one-way valve 60 can be a precompression outlet one-way valve 230, by way of nonlimiting example as shown in FIG. 9. A precompression outlet one-way valve 230 opens, and remains open, above a certain pressure. A precompression outlet one-way valve 230 can help provide for sharp definition of the initiation and cessation of dispensing from the pump sprayer 10. In absence of a precompression outlet one-way valve 230, at the beginning of the pump down stroke liquid may be dispensed under a pressure that is too low for the spray pattern to be fully developed, which may result in undesirable particles size of the spray, dripping, and or low trajectory emissions from the pump sprayer 10. The same phenomena may occur at the end of the down stroke of the piston 80. The precompression outlet one-way valve 230 may be characterized by a cracking pressure. The cracking pressure is the pressure at or above which the precompression outlet one-way valve 230 opens and below which the precompression outlet one-way valve 230 is closed. The precompression outlet one-way valve 230 can be a dome valve 235. The outlet one-way valve 60 can be located at or proximal to the outlet of the piston cavity 90 or be the outlet of the piston cavity 90. A suitable arrangement is shown in FIG. 8 and disclosure related thereto in WO 2008/116656, for example. The outlet one-way valve 60 and inlet one-way valve 50 can be combined onto a single structure, each valve capable of operating independent of one another. For instance a dome valve 235 can be provided with an addition extension that operates as the inlet one-way valve 50. As shown in FIG. 9, there may be a liquid pervious cover 209 over the accumulator piston 205.

Figure 10:
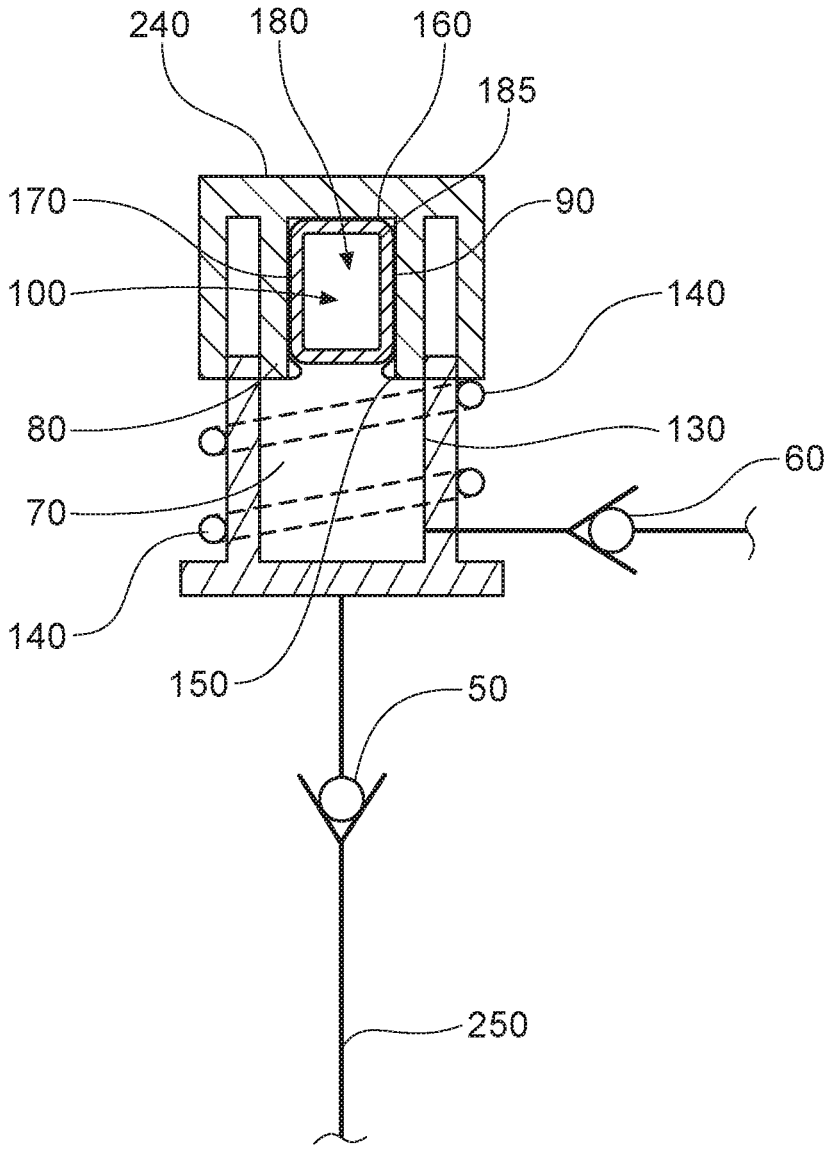
FIG. 10 is a pump in which the actuator is an external surface of the piston.

The actuator 110 can be an external surface 240 of the piston 80, as shown in FIG. 10, or optionally an external surface 240 of a part that moves in concert with and in the same direction as the piston 80. In FIG. 10, the inlet one-way valve 50 and outlet one-way valve 60 are shown schematically and represent the full breadth of variety of one-way valves employed piston pumps for consumer products for home use, including but not limited to slit valves, disc valve, ball, valve, diaphragm valves, and the like.

Such an arrangement can be employed as a pump cap. In contrast to a trigger actuated pump, in which the trigger 120 rotates about a hinge and force applied to the trigger 120 by a user is transferred from the user's finger, through the trigger, to the piston 80, in a pump cap the movement of the actuator 110 can be one-dimensional in the direction of movement of the piston 80.

The pump 40 can further comprise a dip tube 250 upstream of the inlet one-way valve 50. The dip tube 250 may be in fluid communication with the inlet one-way valve 50. The dip tube 250 can provide for a conveyance from the container 25 to the inlet one-way valve 50. If a dip tube 250 is employed the top of the container 25 may be vented or the pump sprayer 10 may be provided with a vent to relieve vacuum developed in the container 25 as a result of drawing liquid out of the container 25. Optionally, the container 25 can be a bag in bottle container in which the outer container is vented to permit the bag to collapse. A dip tube 250 may not be necessary, although it may be helpful, if a bag in bottle container 25 is employed.

The parts of the pump sprayer 10 can be fabricated from various types of plastics, including but not limited to, polyolefins, for example polypropylene and polystyrene. These parts can be conveniently manufactured by injection molding.

Figure 11:
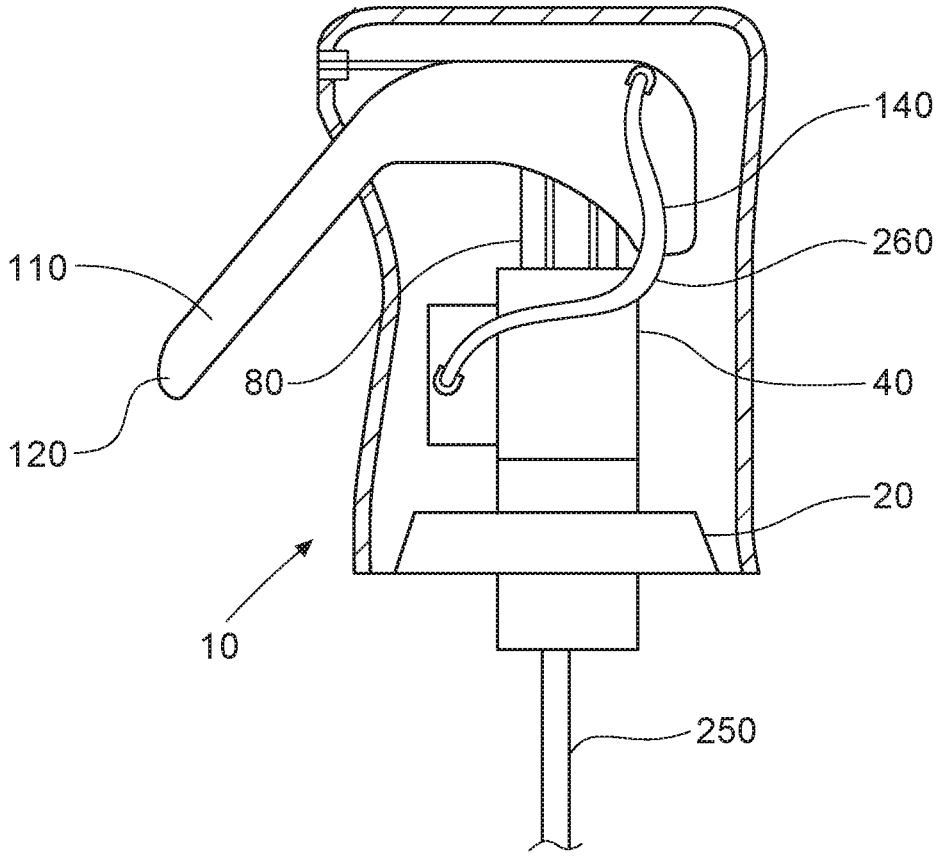
FIG. 11 is a trigger actuated pump.

The pump 40 can be configured to have a trigger 120 and drive the piston 80 up and down, as shown in FIG. 11. As shown in FIG. 11, the resilient member 140 can be a leaf spring 260. The trigger 120 can be movable in a predominately up and down motion to actuate the pump 40.

A variety of different types of resilient members 140 can be employed. The resilient member 140, or multiple resilient members 140, can be a helical spring or a leaf spring, or any other type of mechanical structure that functions as a spring in that it can store potential energy as a function of strain or deformation. Helical springs such as compression helical springs, conical springs, volute springs, or disc or bevel springs can be employed as the resilient member 140. The resilient member 140 can have a linear rate, progressive rate, or dual spring rate of stored energy as a function of deformation. The resilient member 140 can be within the pump chamber 70. Optionally, the resilient member 140 can be external to the pump chamber 70, which can help to overcome problems that might occur if the liquid 30 is incompatible with the resilient member 140.

Combinations

An example is below:

A. A pump (40) comprising:
- an inlet one-way valve (50);
- a pump chamber (70) downstream of and in fluid communication with said inlet one-way valve;
- a piston (80) slideably engaged with said pump chamber;
- a piston cavity (90) within said piston and in fluid communication with said pump chamber;
- a liquid accumulator (100) operable within said piston cavity;
- an actuator (110) engaged with said piston;
- and an outlet one-way valve (60) downstream of and in fluid communication with said pump chamber.

B. The pump according to Paragraph A, wherein said pump chamber further comprises a piston bore (130) and said piston is slideably engaged with said piston bore.

C. The pump according to Paragraph A or B, wherein said piston cavity is defined by a piston cavity opening (150) oriented towards said pump chamber and a piston cavity closed end (160) oriented towards said actuator and a piston cavity peripheral wall (170) extending from said piston cavity closed end to said piston cavity opening.

D. The pump according to any of Paragraphs A to C, wherein said piston cavity peripheral wall is slideably engaged with said pump chamber.

E. The pump according to any of Paragraphs A to D, wherein said pump further comprises a resilient member (140) engaged with said actuator; wherein said pump chamber has a pump chamber volume that is a function of position of said piston; and wherein said resilient member is biased to expand said pump chamber volume.

F. The pump according to Paragraph E, wherein said resilient member is outside of said pump chamber.

G. The pump according to any of Paragraphs A to E, wherein said actuator is a trigger (120).

H. The pump according to any of Paragraphs A to G, wherein said outlet one-way valve is a precompression valve (230).

I. The pump according to any of Paragraphs A to H, wherein said liquid accumulator is selected from the group consisting of a bladder accumulator (180), a diaphragm accumulator (190), a gas filled piston accumulator (200), a spring type accumulator (210), and a compressible medium accumulator (220).

J. The pump according to any of Paragraphs A to I, wherein said liquid accumulator is a bladder accumulator (180).

K. The pump according to any of Paragraphs A to J, wherein said actuator is an external surface (240) of said piston.

L. The pump according to any of Paragraphs A to K, wherein said pump comprises a dip tube (250) upstream of said inlet one-way valve.

M. The pump according to any of Paragraphs A to L, wherein said liquid accumulator is a bladder accumulator (180) positioned entirely within said piston cavity.

N. The pump according to any of Paragraphs A to M, wherein said pump chamber has an upstroke pump chamber volume and said piston cavity has a piston cavity volume, wherein said piston cavity volume is from about 0.2 to about 0.8 of said pump chamber volume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pump comprising:
- an inlet one-way valve;
- a pump chamber downstream of and in fluid communication with said inlet one-way valve;
- a piston slideably engaged with said pump chamber;
- a piston cavity within said piston and in fluid communication with said pump chamber;
- a liquid accumulator operable within said piston cavity and accumulating liquid with increasing pressure and discharging liquid with decreasing pressure, wherein said liquid accumulator is a bladder accumulator, wherein said liquid accumulator is in fluid communication with said pump chamber during a downstroke of said piston;
- an actuator engaged with said piston;
- and an outlet one-way valve downstream of and in fluid communication with said pump chamber;
- wherein:
  - said piston cavity is defined by a piston cavity opening oriented towards said pump chamber and a piston cavity closed end oriented towards said actuator and a piston cavity peripheral wall extending from said piston cavity closed end to said piston cavity opening, the pump chamber has an upstroke pump chamber volume and the piston cavity has a piston cavity volume that is from about 0.2 to about 0.8 of the upstroke pump chamber volume, and the upstroke pump chamber volume is measured between the inlet one-way valve and the outlet one-way valve with the piston located at its upstroke position.

2. The pump according to claim 1, wherein said pump chamber further comprises a piston bore and said piston is slideably engaged with said piston bore.

3. The pump according to claim 2, wherein said piston cavity peripheral wall is slideably engaged with said pump chamber.

4. The pump according to claim 2, wherein said pump further comprises a resilient member engaged with said actuator; wherein said pump chamber has a pump chamber volume that is a function of position of said piston; and wherein said resilient member is biased to expand said pump chamber volume.

5. The pump according to claim 4, wherein said actuator is a trigger.

6. The pump according to claim 5, wherein said piston cavity peripheral wall is slideably engaged with said pump chamber.

7. The pump according to claim 6, wherein said resilient member is outside of said pump chamber.

8. The pump according to claim 7, wherein said outlet one-way valve is a precompression valve.

9. The pump according to claim 1, wherein said actuator is a trigger.

10. The pump according to claim 1, wherein said pump further comprises a dip tube upstream of said inlet one-way valve.

11. The pump according to claim 1, wherein said bladder accumulator is positioned entirely within said piston cavity.

12. A pump comprising:

an inlet one-way valve;

a pump chamber downstream of and in fluid communication with said inlet one-way valve;

a piston slideably engaged with said pump chamber;

a piston cavity within said piston and in fluid communication with said pump chamber;

a liquid accumulator operable within said piston cavity, wherein said liquid accumulator is a diaphragm accumulator, wherein said liquid accumulator is in fluid communication with said pump chamber during a downstroke of said piston;

an actuator engaged with said piston;

and an outlet one-way valve downstream of and in fluid communication with said pump chamber;

wherein:

said piston cavity is defined by a piston cavity opening oriented towards said pump chamber and a piston cavity closed end oriented towards said actuator and a piston cavity peripheral wall extending from said piston cavity closed end to said piston cavity opening, the pump chamber has an upstroke pump chamber volume and the piston cavity has a piston cavity volume that is from about 0.2 to about 0.8 of the upstroke pump chamber volume, and the upstroke pump chamber volume is measured between the inlet one-way valve and the outlet one-way valve with the piston located at its upstroke position.

13. The pump according to claim 12, wherein said pump chamber further comprises a piston bore and said piston is slideably engaged with said piston bore.

14. The pump according to claim 13, wherein said piston cavity peripheral wall is slideably engaged with said pump chamber.

15. The pump according to claim 12, wherein said pump further comprises a resilient member engaged with said actuator; wherein said pump chamber has a pump chamber volume that is a function of position of said piston; and wherein said resilient member is biased to expand said pump chamber volume.

16. The pump according to claim 15, wherein said resilient member is outside of said pump chamber.

17. The pump according to claim 16, wherein said outlet one-way valve is a precompression valve.

* * * * *